United States Patent [19]

Bracht et al.

[11] Patent Number: 4,677,940

[45] Date of Patent: Jul. 7, 1987

[54] COOLING SYSTEM FOR A COMPACT GENERATOR

[75] Inventors: Jeffrey L. Bracht, Sheboygan; Martin W. Heinrich, Cedar Grove; Richard D. van Maaren, Sheboygan; Richard L. Sleder, Howards Grove, all of Wis.

[73] Assignee: Kohler Co., Kohler, Wis.

[21] Appl. No.: 764,869

[22] Filed: Aug. 9, 1985

[51] Int. Cl.[4] ..... F02B 63/04

[52] U.S. Cl. ..... 123/2; 123/41.7; 290/1 A

[58] Field of Search ..... 123/2, 41.7, 195 C, 123/198 E; 290/1 R, 1 A, 1 C

[56] References Cited

U.S. PATENT DOCUMENTS

| | | | |
|---|---|---|---|
| 1,451,201 | 4/1923 | Brown et al. | 123/41.66 |
| 1,491,361 | 4/1924 | Reddig | 123/41.66 |
| 3,259,752 | 7/1966 | Honda | 290/1 B |
| 4,173,951 | 11/1979 | Ishihara | 290/1 B |
| 4,540,888 | 9/1985 | Drewry et al. | 290/1 R |

*Primary Examiner*—William A. Cuchlinski, Jr.
*Attorney, Agent, or Firm*—Barry E. Sammons

[57] ABSTRACT

A compact generator unit including a cooling system in which the engine and generator are mounted at points outside of the perimeter of the generator fan such that the generator fan serves to cool both the generator and the engine.

4 Claims, 3 Drawing Figures

COOLING SYSTEM FOR A COMPACT GENERATOR

BACKGROUND OF THE INVENTION

The invention relates to generators, and, in particular, to a cooling system for a compact generator unit. In compact generator units which are enclosed by a shroud for aesthetic purposes and to prevent people from touching the unit, removal of heat from the generator unit can become a problem. Due to the enclosure of the unit and the continuous running of the engine, it is usually necessary to use a non-standard engine which has been designed for greater heat transfer than a standard engine. The cost of such a special engine is much greater than the cost of a standard engine.

In typical units of the prior art, the engine is mounted to the generator by means of a generator adaptor. The generator adaptor serves as a spacer between the engine and the generator and as a partial enclosure for the generator fan, so that air flow from the generator fan is prevented by the generator adaptor from reaching the engine.

SUMMARY OF THE INVENTION

The present invention provides a compact generator unit which includes a standard internal combustion engine, having an engine housing and a vertical shaft. It also includes a generator which lies below the engine and is driven by the vertical shaft of the engine. The generator includes a generator fan, which is located on top of the generator, and a generator housing. The engine housing and the generator housing are coupled together at points outside of the perimeter of the generator fan so that the engine is directly above the generator fan and the generator fan draws air up through the generator and across the bottom of the engine, so as to cool both the generator and the engine.

The present invention also includes a shroud which directs the air flow from the engine fan across the engine's cooling fins and across the muffler. These improvements serve to cool the engine and muffler more efficiently than in generator units of the prior art while, at the same time, permitting the unit to be more compact than those of the prior art.

DESCRIPTION OF THE PREFERRED EMBODIMENT

Figure 1:
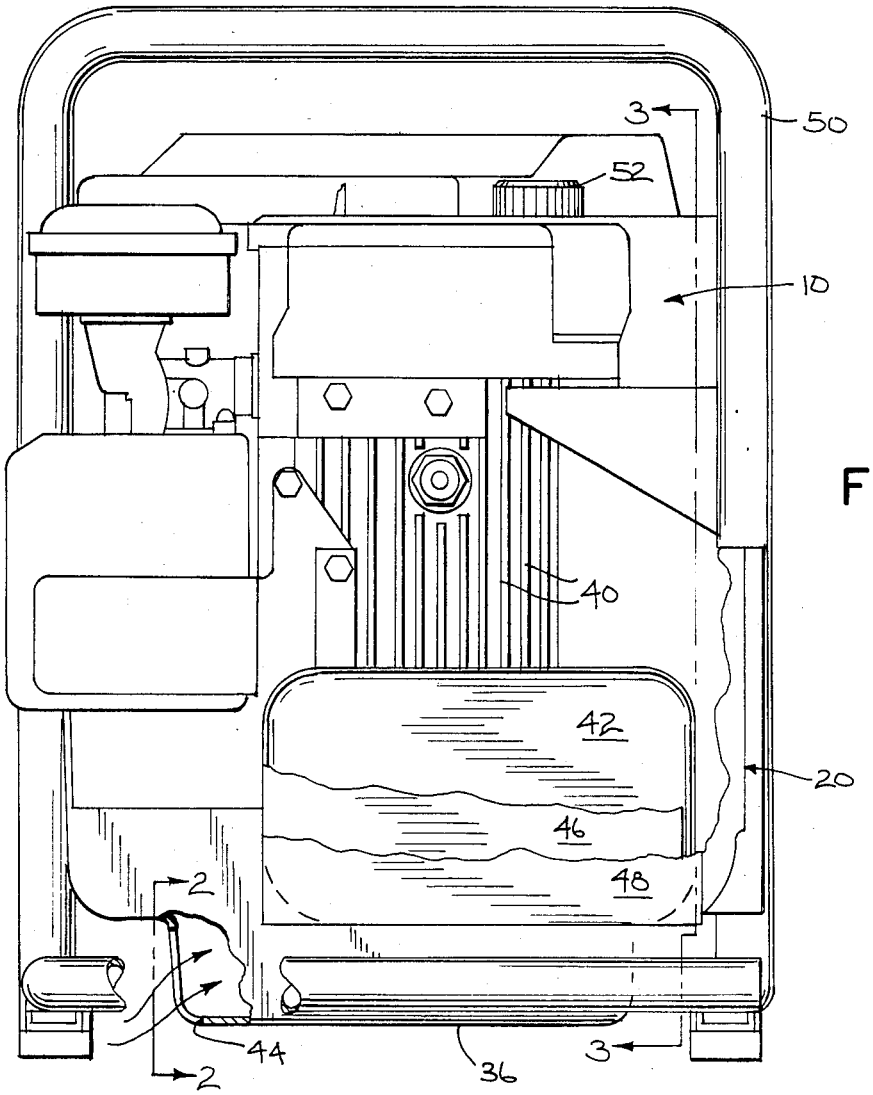
FIG. 1 is a front view partially in section of a generator made in accordance with the present invention.
Figure 3:
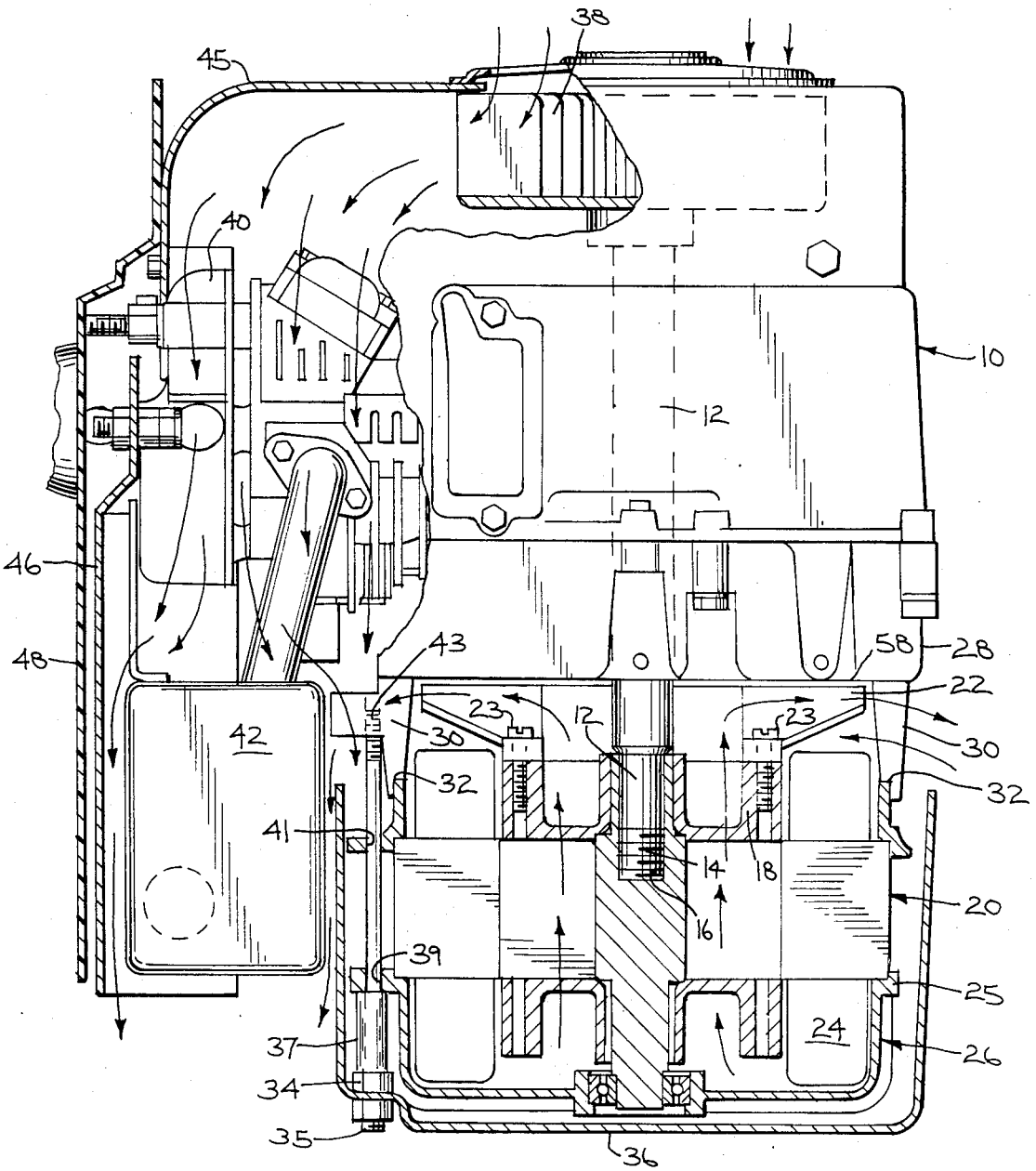
FIG. 3 is a view taken along the section 3—3 of FIG. 1.

FIGS. 1 and 3 show an internal combustion engine 10, which has a vertical shaft 12 that projects downward beyond the engine. The engine is a standard engine available on the market, made by such manufacturers as Briggs & Stratton except for specially cast standoffs, which will be described later. The end of the vertical shaft 12 has threads 14 which mate with threads 16 in the rotor 18 of the generator 20. Attached to the top of the rotor 18 is a fan 22, which is designed to pull air up through the generator and discharge it radially outward as shown by the arrows. A fan which blows air radially outward is called a radial fan. The radial fan 22 is driven by the shaft 12, and has blades 19 which extend between first and second axial faces 3 and 5. The first axial face 3 is closed except for the central opening 17. The second axial face 5 is open, but the engine sump 58 serves as an enclosure for the second axial face 5, so the fan operates as a closed fan. The central opening 17 receives the air, and the fan then sends the air across the oil sump 58 and radially outward. With this fan design, all the air which goes through the fan passes along the entire fan blade from the central opening 17 to the outer radial edge of the fan, so that a large volume of air flows across the surface of the oil sump 58 to cool the engine. The generator fan 22 is mounted on the rotor 18 by bolts 23. The stator 24 of the generator 20 is mounted in the generator housing 26. The generator housing 26 includes two pieces, an end bracket 25 which is piloted to the lower portion of the stator 24, and a generator adaptor 27 which is piloted to the upper portion of the stator 24. The engine housing 28 has standoffs 30 cast at intervals around the engine as a part of the engine 10, and these pilot to portions 32 of the generator adaptor 27, so that the engine housing 28 and generator housing 26 are attached to each other in positions outside of the perimeter of the generator fan 22. This arrangement leaves openings to the outside between the engine and generator and allows the engine 10 to serve as a partial enclosure for the generator fan 22. Bolts 34 hold the two housings together; they also serve to attach part of the shroud 36 to the unit. In assembling the unit, the engine and generator are connected together first, and the shroud 36 is attached later. Each bolt 34 passes through a spacer 37, through an opening 39 in the end bracket 25, through an opening 41 in the generator adapter 27, and is threaded into a threaded hole 43 which is part of the cast standoff 30 in the engine housing 28. When the bolts 34 are tightened, the engine housing 28, generator housing 26, and stator 24 are clamped together and held in position. The bolts 34 have threads 35 which extend beyond their heads and which pass through the openings in the shroud 36 for attaching the shroud to the rest of the assembly.

At the top of the engine 10 is an engine fan 38. The engine 10 also has fins 40 for cooling the engine 10 and a muffler 42, which lies below the fins 40, for muffling the engine noise.

Figure 2:
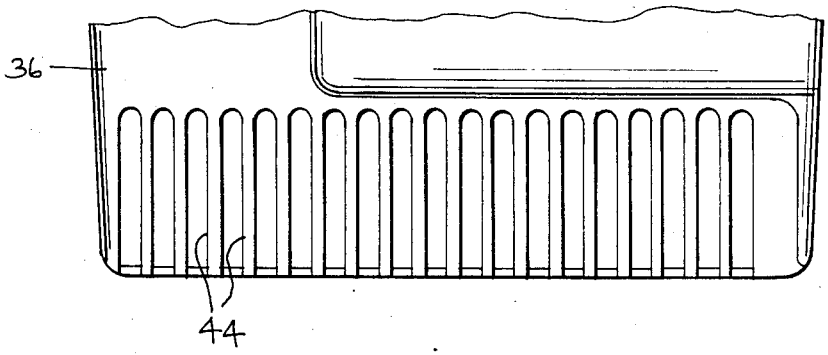
FIG. 2 is a view taken along the section 2—2 of FIG. 1.

The shroud 36 which encloses the generator 20 has openings 44 shown in FIGS. 1 and 2 to permit air to enter at the bottom of the generator for cooling the generator 20. A shroud arrangement including an engine shroud 45 and a muffler shroud 46 encloses the engine and muffler so that air from the engine fan 38 is directed over the cooling fins 40 and across the muffler 42 as shown by the arrows. The muffler and generator shrouds 46 and 36 also direct air from the generator fan 22 over the muffler. A decorative shroud 48 encloses the muffler shroud 46.

Other features of the present device which can be seen in the drawings are a handle 50 for carrying the generator and an oil cap 52.

The operation of this compact generator unit is as follows: When the engine 10 runs, it drives the vertical shaft 12 which drives the rotor 18 of the generator 20. The shaft 12 also drives the engine fan 38 and the generator fan 22. The engine fan 38 pulls air in from the top of the engine and discharges it underneath the engine shroud 45 and muffler shroud 46, across the fins 40, across the muffler 42, and then out as shown by the arrows. The shrouds 45, 46 help direct the air over the fins and muffler in a more efficient manner than it would normally flow without the shrouds.

The generator fan 22, which is also driven by the vertical shaft 12, draws air in through the openings 44 in the generator shroud 46 up through the generator 20, pulls additional air in from openings between the engine and the generator, blows the air across the base of the engine housing 28, which serves as a partial enclosure for the generator fan 22, and then radially outward as shown by the arrows. The base of the engine housing 28 serves as the engine sump 58. By blowing air directly on the engine sump 58, the generator fan 22 helps cool the oil in the engine. Some of the air which flows radially outward from the generator fan also flows across the muffler 42 as shown by the arrows. Thus, the generator fan 22 serves to cool both the generator 20 and the engine 10.

What is claimed is:

1. A compact generator unit, comprising:

A. an internal combustion engine, including an engine housing and a vertical shaft; and B. a generator which lies below said engine and is driven by said vertical shaft, said generator including a generator fan which is a radial fan located on the top of said generator; and a generator housing; wherein said engine housing and said generator housing are coupled together at points outside of the perimeter of said generator fan such that said engine is directly above said generator fan and such that said generator fan draws air up through said generator and across the bottom of said engine, thereby cooling both said generator and said engine.

2. A compact generator unit as recited in claim 1, wherein said engine serves as a partial enclosure for said generator fan.

3. A compact generator unit as recited in claim 2, wherein said engine housing includes standoffs which pilot to said generator housing and wherein said standoffs and said generator housing define aligned holes outside the perimeter of said generator fan which receive bolts for clamping said engine housing and said generator housing together, said standoffs defining openings between said generator and said engine such that air can flow in and out between said generator and said engine.

4. A compact generator unit as recited in claim 2, wherein said engine also includes an engine fan located on the top of said engine; cooling fins along the side of said engine; and a muffler; and further comprising:

a shroud arrangement which directs the air flow from said engine fan across said cooling fins and across said muffler so as to cool both said engine and said muffler, said shroud arrangement also serving to direct some of the air flow from said generator fan across said muffler.

* * * * *